US009057192B2

(12) United States Patent
Litaize

(10) Patent No.: US 9,057,192 B2
(45) Date of Patent: Jun. 16, 2015

(54) METHOD FOR PRODUCING A BUILDING HAVING A PREFABRICATED WOOD FRAMEWORK, AND RESULTING BUILDING

(75) Inventor: Pierre-Emmanuel Litaize, Thusy (FR)

(73) Assignee: ELMERE, Besancon (FR)

( * ) Notice: Subject to any disclaimer, the term of this patent is extended or adjusted under 35 U.S.C. 154(b) by 219 days.

(21) Appl. No.: 13/379,420

(22) PCT Filed: Aug. 24, 2010

(86) PCT No.: PCT/FR2010/051766

§ 371 (c)(1),
(2), (4) Date: Mar. 13, 2012

(87) PCT Pub. No.: WO2011/039439

PCT Pub. Date: Apr. 7, 2011

(65) Prior Publication Data

US 2012/0174518 A1 Jul. 12, 2012

(30) Foreign Application Priority Data

Sep. 29, 2009 (FR) ..... 09 56729

(51) Int. Cl.

| | |
|---|---|
| ***E04C 2/26*** | (2006.01) |
| ***B28B 19/00*** | (2006.01) |
| ***E04C 2/38*** | (2006.01) |
| *E04B 1/61* | (2006.01) |

(52) U.S. Cl.

CPC . *E04C 2/26* (2013.01); *B28B 19/00* (2013.01); *E04B 1/6158* (2013.01); *E04B 2001/6195* (2013.01); *E04C 2/386* (2013.01)

(58) Field of Classification Search

CPC ..... B21D 7/00; E04C 2/08; E04C 2003/0491; E04C 2003/0434; E04C 2003/0413; E04F 15/02; B29C 66/43

USPC ..... 29/897, 897.31, 897.32, 897.34; 52/309.7, 309.12, 309.15, 309.16, 52/309.17, 782.1

See application file for complete search history.

(56) References Cited

U.S. PATENT DOCUMENTS

| | | | | |
|---|---|---|---|---|
| 3,529,389 | A * | 9/1970 | Wilkins | 174/497 |
| 4,720,948 | A * | 1/1988 | Henley et al. | 52/91.3 |
| 4,856,244 | A | 8/1989 | Clapp | |
| 5,568,998 | A * | 10/1996 | Egan et al. | 405/262 |
| 2006/0156638 | A1 * | 7/2006 | Edkins | 52/58 |
| 2007/0062151 | A1 | 3/2007 | Smith | |

FOREIGN PATENT DOCUMENTS

| | | | |
|---|---|---|---|
| AU | 2009100582 | A4 * | 7/2009 |
| WO | 2008104772 | A1 | 9/2008 |

* cited by examiner

*Primary Examiner* — David Bryant
*Assistant Examiner* — Lee A Holly
(74) *Attorney, Agent, or Firm* — Bachman & LaPointe, P.C.

(57) ABSTRACT

A method is provided for producing a structure from prefabricated panels to be connected mounted on a free-standing supporting framework, each of the panels being made beforehand from a wood framework into which an inner insulation and inner and outer facings are capable of being built, the panels being connected together by a linking mechanism in a vertical direction and in a horizontal direction, wherein the method is characterized in that a subassembly is made from a quadrangular wood frame inside of which vertical posts are arranged on which mechanical connectors are placed, enabling the arrangement, support, and prepositioning of a metal reinforcement on the connectors that are in place. The thus-produced subassembly is placed in a mold so as to be overmolded from concrete constituting the inner facing.

8 Claims, 9 Drawing Sheets

METHOD FOR PRODUCING A BUILDING HAVING A PREFABRICATED WOOD FRAMEWORK, AND RESULTING BUILDING

BACKGROUND

This invention relates to a method for producing wood frame buildings, constituted of entirely prefabricated panels and assembled in the factory, added to a supporting complementary framework, for example of metal, and possibly completed, according to the configurations, with an elevator shaft, itself prefabricated and preassembled.

Originally, wood framework houses were exclusively intended for dwellings; the joinery work was supporting, without additional structure, without interior insulation and assembled on site.

In this way, an industrialization was rendered impossible, and consequently the installation of the final inner and outer facings could not be carried out in the workshop.

Various adaptations made it possible to implement, on site or not on site, the exterior joinery work, the outer facing, the insulation. But this even so required on-site finishing work, and in particular the treatment of air and water tightness. These various methods, coming from the dry process, had a lack of inertia which resulted on a regular basis in situations of major discomfort in the summer.

Subsequently, various methods for producing prefabricated panels appeared on the market.

It is as such that it is known to produce panels to be assembled together in order to provide for the continuity and the transmission of stresses and other shearing stresses, with the assembly being carried out via mechanical junction elements.

Such known panels are comprised of a wood framework formed of vertical and horizontal elements, of an outer layer of concrete and of inner insulation elements that are to later receive the inner facing.

It is well understood that such methods require reworking on the site, in particular concerning the inner facing.

It has also been proposed to reinforce the layer of concrete using a metal reinforcement netting, but the latter will have to be maintained in place during the molding operation.

Various solutions have been proposed to date, but they are generally complicated as they implement lag bolts, fastenings, bolting and other assembly staples which also require costly labor.

SUMMARY OF THE INVENTION

This invention has for purpose to overcome these disadvantages by producing panels intended to be fastened on a free-standing supporting complementary framework, comprising a frame and specific reentrants intended to receive and to facilitate the anchoring of said panels and the transmission of the mechanical stresses. Such panels will constitute the facade. They will be insulated, coated with inner and outer facing, and entirely prefabricated and matched.

To this effect, the invention relates to a method for producing a structure using prefabricated panels, intended to be added to a free-standing supporting framework, with each of the panels being produced beforehand using a wood framework whereon can be integrated an inner insulation and inner and outer facings, said panels being connected together by linking means in a vertical direction and in a horizontal direction, said method characterized in that:

Production of a subassembly:

- formation of the wood framework using a quadrangular wood frame, using upper and lower lateral elements assembled together and corresponding to the external contour of the panel,
- installation of wood vertical posts inside the frame, according to a predetermined spacing,
- installation of inner facing wood framework mechanical connectors, on the vertical posts of the frame,
- arrangement, support and prepositioning of a metal reinforcement on the connectors in place on the wood framework,
- connection, on the vertical sides of the reinforcement, of lateral assembly connectors between them of two successive panels, Overmolding of the subassembly:

- installation of the subassembly produced as such, in a mold (not shown) of dimensions corresponding to those of the panel to be obtained, by directing the metal reinforcement toward the bottom of the mold and by maintaining it at a distance from this bottom, according to a value equal to the thickness of the inner facing desired,
- pouring a material through the wood framework, intended to constitute the inner facing,
- unmolding of the panel after drying of the material, Finishing:

- installation of a final outer facing or of a holding support.

This will have for advantage to be able to implement in the factory the entire complex, from the outer facing to the inner facing, and this definitively.

This will therefore allow for a very rapid implementation on the work site.

The inner coating obtained as such will be perfectly smooth and will allow for all possible finishes (untreated, varnished, painted, coated, etc.), waterproof, adapted to environments with high hygrometry, incombustible, rot-proof, impact-resistant.

A mineral wool insulation, fire resistant, reinforced, making it possible to produce low energy consumption buildings very quickly, is installed.

As such is produced a passive prefabricated architecture and accessible economically, while still offering a thermal inertia providing comfort, in summer as in winter, as well as substantial acoustic comfort.

The invention further relates to the characteristics which shall appear in the following description, and which have to be considered in isolation or according to all of their technical combinations possible.

BRIEF DESCRIPTION OF THE DRAWINGS

This description provided by way of an unrestricted example, will make it possible to better understand how the invention can be produced in reference to the annexed drawings wherein.

DETAILED DESCRIPTION OF THE PREFERRED EMBODIMENT(S)

Figure 1:
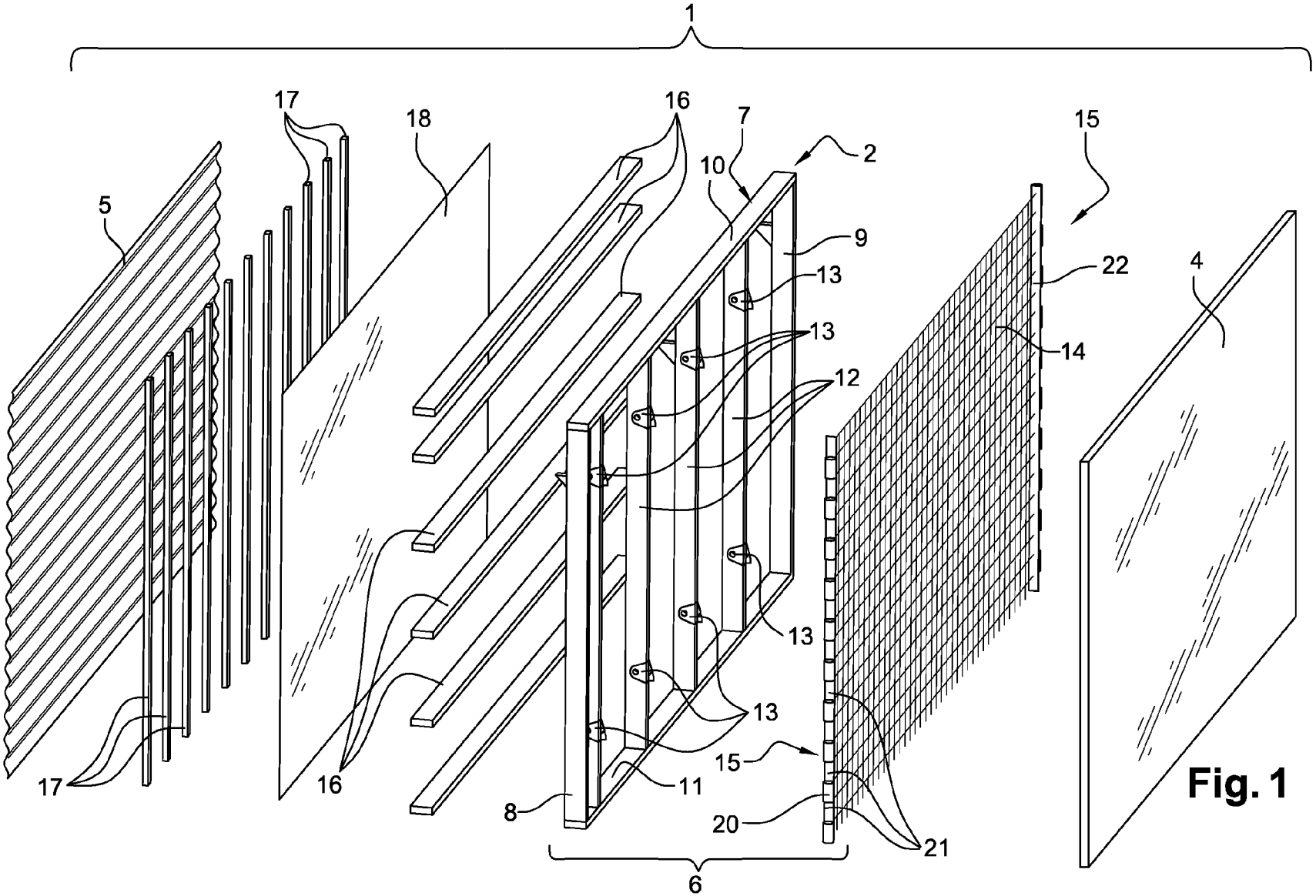
FIG. 1 shows as an exploded perspective a prefabricated panel according to the invention, without insulation for better understanding.
Figure 2:
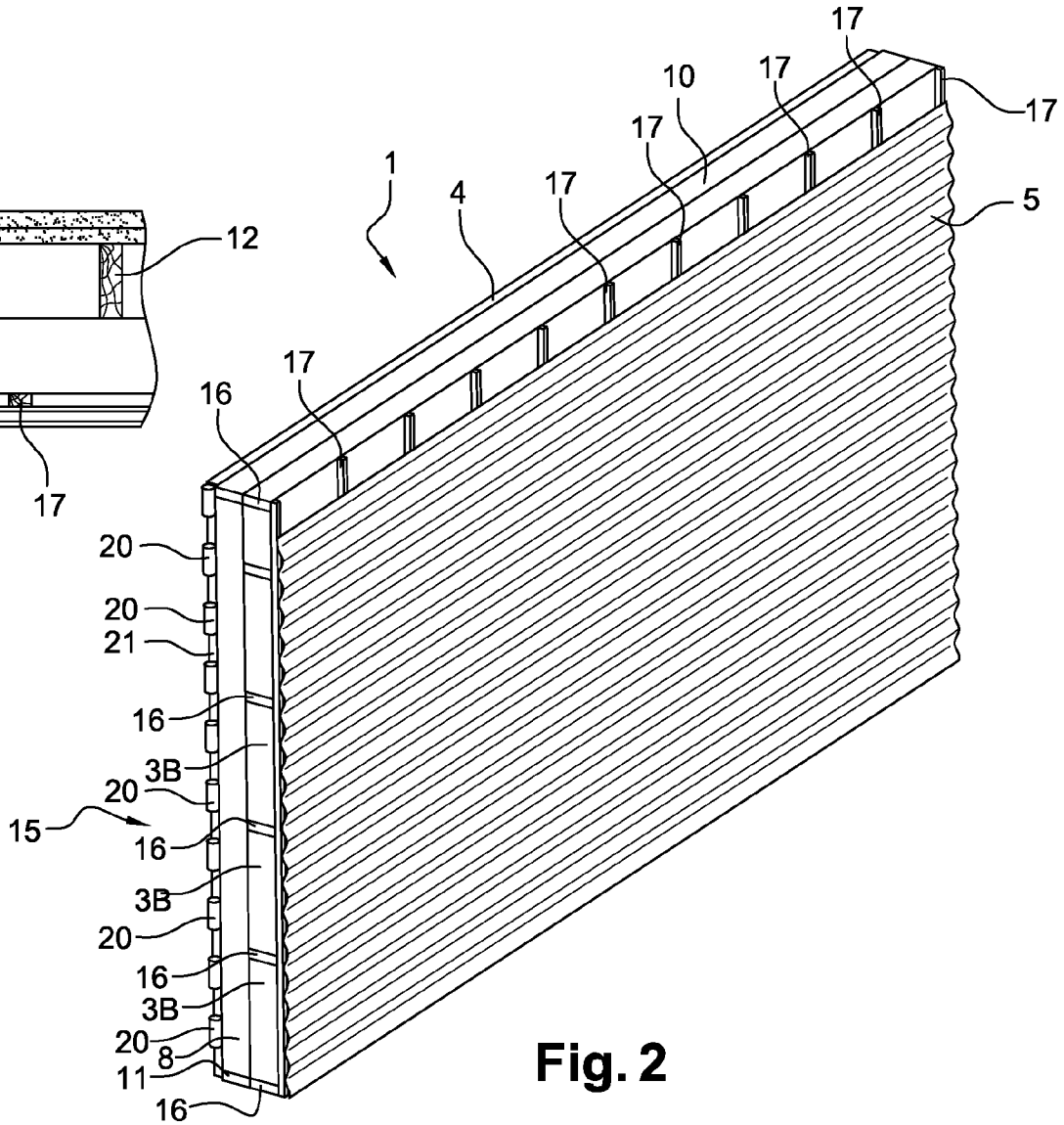
FIG. 2 is a view of a panel according to FIG. 1, after production with insulation.
Figure 3:
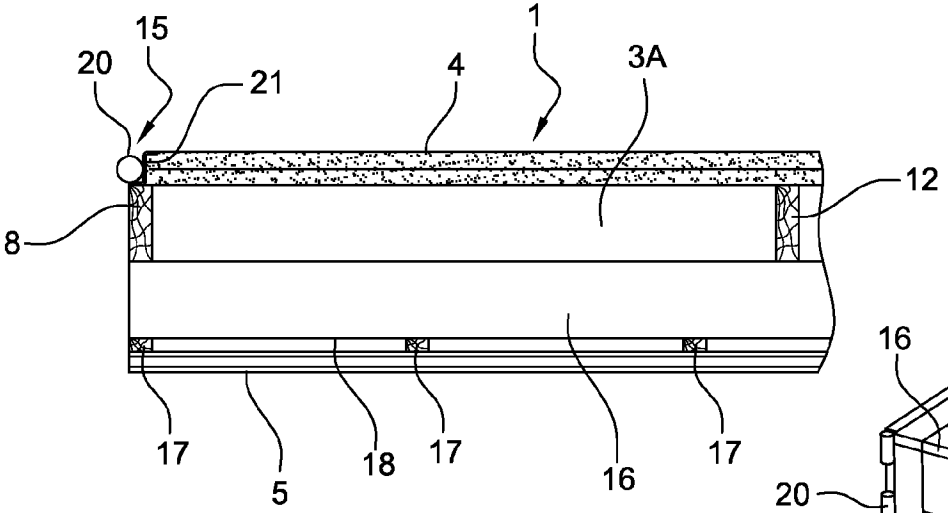
FIG. 3 is a partial top view, according to FIG. 2.

The invention relates to a method for producing a structure using prefabricated panels 1 designated globally in the figures.

These panels are intended to be added to a free-standing supporting framework (not shown).

The panels 1 are produced beforehand using a wood framework 2 whereon can be integrated an inner insulation 3 and inner 4 and outer 5 facings, said panels 1 being connected together by linking means, in a vertical direction and in a horizontal direction.

According to the invention, the method is characterized in that:

Production of a subassembly 6:

- formation of the wood framework 2 using a quadrangular wood frame 7, using upper and lower lateral elements 8, 9, 10, 11 assembled together and corresponding to the external contour of the panel 1,
- installation of wood vertical posts 12 inside the frame 7, according to a predetermined spacing,
- installation of wood framework 2—inner facing 4 mechanical connectors 13, on the vertical posts 12 of the frame 7,
- arrangement, support and prepositioning of a metal reinforcement 14 on the connectors 13 in place on the wood framework 2,
- connection, on the two vertical sides of the reinforcement 14, of lateral assembly connectors 15 together of two successive panels 1, Overmolding of the subassembly 6:

- installation of the subassembly 6 produced as such, in a mold (not shown) of dimensions corresponding to those of the panel 1 to be obtained, by directing the metal reinforcement 14 toward the bottom of the mold and by maintaining it at a distance from this bottom, according to a value equal to the thickness of the inner facing 4 desired,
- pouring of a material through the wood framework 2, intended to constitute the inner facing 4,
- unmolding of the panel 1 after drying of the material, Finishing:

- installation of a final outer facing 5 or of a holding support.

As can be seen in FIG. 1, the wood-concrete connectors 13 are placed at least in the vicinity of the upper and lower end portions of each vertical post 12.

Preferentially, wood horizontal crosspieces 16 are also installed on the vertical posts 12, according to a predetermined spacing.

As can be seen in all of the figures, except in FIG. 1, insulating elements 3A are arranged between the vertical posts 12, after pouring of the material comprising the inner facing 4 and prior to the installation of the horizontal crosspieces 16.

Also insulation elements 3B are arranged between the horizontal crosspieces 16, successively to the installation of the insulation elements 3A.

According to another phase of the method, on the crosspieces 16 is installed a rain barrier 18, fastened and maintained by cleats 17, horizontal or vertical.

Successively to the installation of the rain barrier 18, is installed the outer facing 5 or it holding support, by fastening on the cleats 17 and/or the horizontal crosspieces 16.

The outer facing 5 can be comprised of wooden battens, metal plates, a canvas, etc.

Preferentially, the metal reinforcement 14 to be integrated to the material of the inner facing 4 during its pouring is a welded metal netting.

Of course, this can be any other type of reinforcement.

In the same way, the material comprising the inner coating, to be poured into the mold, is a smooth or molded concrete finish. But this can also be any other material.

Figures 4, 5, 6, 7, 8, 9, 10, 11, 12:
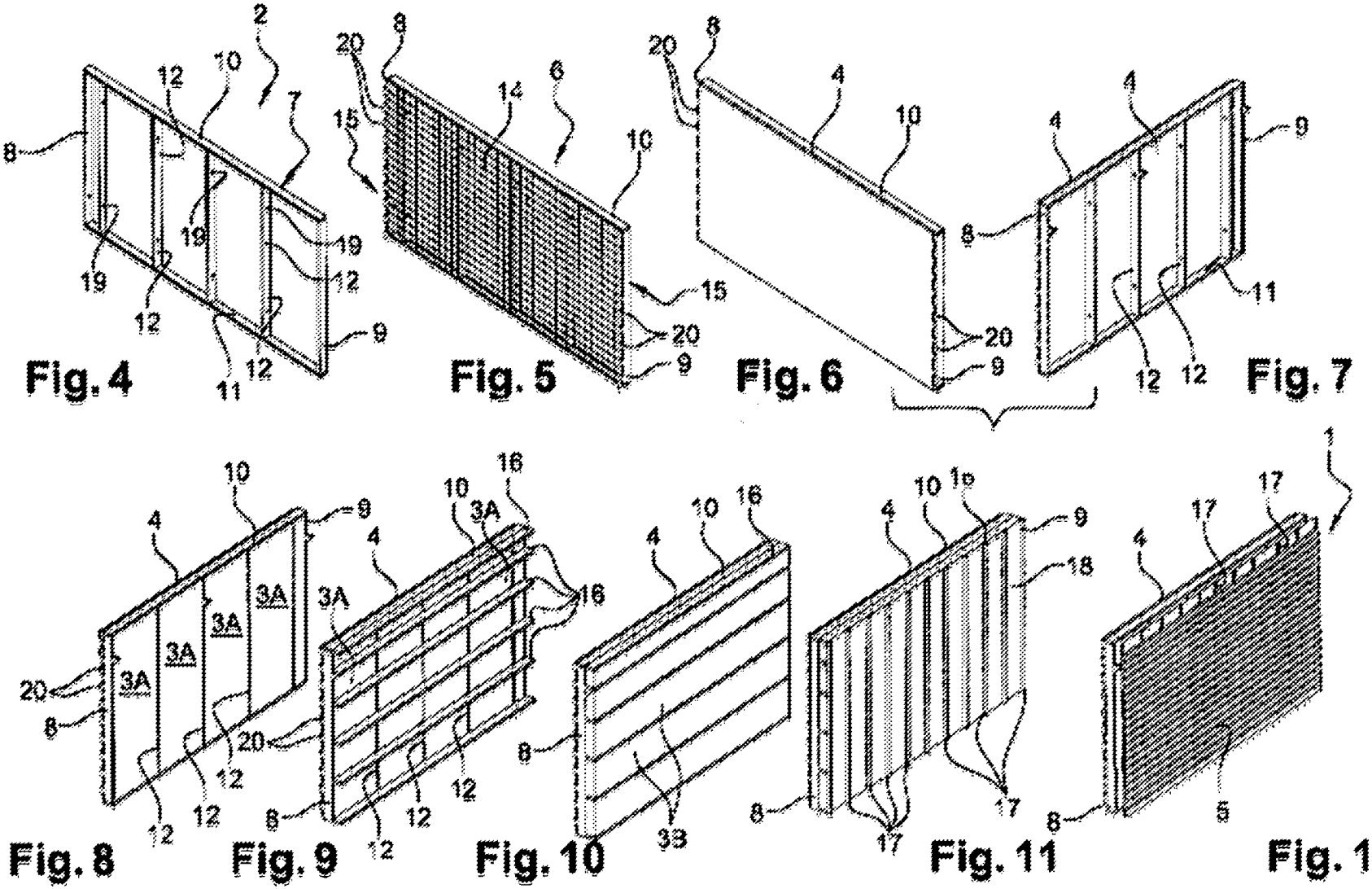
FIGS. 4 to 12 show, in perspective, a diagram of the steps of producing a panel, with insulation incorporated according to FIGS. 2 and 3.

FIGS. 4 to 12 summarize well the various steps in producing the panel according to the invention:

Step no. 1 according to FIG. 4 shows the frame 7 constituting the wood framework 2 on the vertical posts 12 whereon were installed wood concrete connectors 13.

Step no. 2 according to FIG. 5 shows the wood framework 2 of the previous step, whereon has been attached the metal reinforcement 14, in order to constitute the subassembly 6.

Step no. 3 according to FIGS. 6 and 7 shows the subassembly 6 according to the previous step, after molding of the inner facing 4. FIGS. 6 and 7 show in fact the front and the back of the panel 1 in the process of production.

Step no. 4 according to FIG. 8 shows the installation of insulation 3A between the vertical posts 12.

Step no. 5 according to FIG. 9 shows the installation of horizontal crosspieces 16 on the vertical posts 12.

Step no. 6 according to FIG. 10 shows the installation of horizontal insulation 3B between the horizontal crosspieces 16.

Step no. 7 according to FIG. 11 shows the installation of a rain barrier 18, then the installation of cleats 17 fastened on the horizontal crosspieces 16 located under the rain barrier 18.

Step no. 8 according to FIG. 12 shows the installation of an outer facing 5 on the cleats 17.

Figure 13:
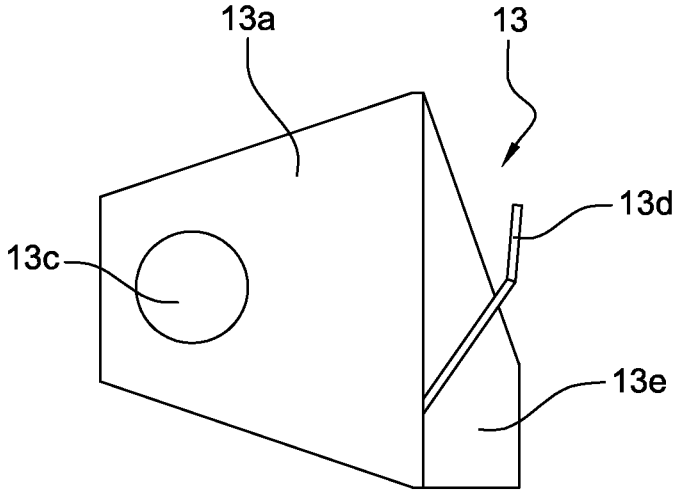
FIG. 13 is a lateral view of a wood framework-concrete inner facing linking connector.
Figure 14:
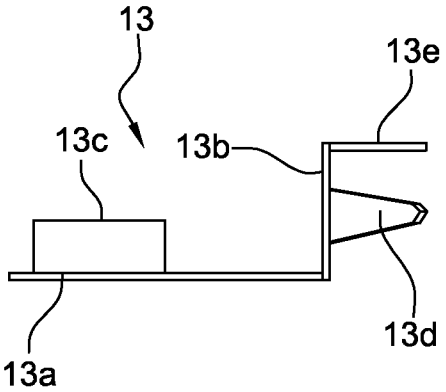
FIG. 14 is a top view according to FIG. 13.
Figure 15:
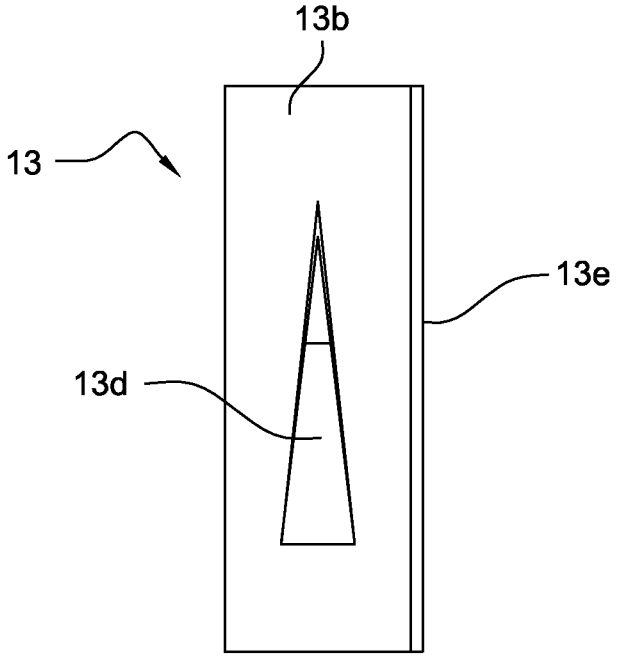
FIG. 15 is a front view of the connector according to FIGS. 13 and 14.

As shown in FIGS. 13, 14 and 15, wood framework 2 inner facing 4 the mechanical connectors 13, maintain and preposition the metal reinforcement 14 on the vertical posts 12 of the frame 7, in order to constitute a subassembly 6, intended to receive the inner coating 4 by molding, are comprised of a metal part, globally a square. Its faces 13*a*, 13*b* perpendicular to each other are intended to be thrust on a face and an adjacent edge of the vertical posts 12. The face 13*a* of the square 13 corresponding to the face of the post 12 is provided with a hole 13*c* across from a corresponding hole 19 of the post 12, in order to allow for the fastening on the latter of said square 13, by the intermediary of a linking element by clamping. The other face of the square 13*b* corresponding to the edge of the post is freely pressing against the latter and comprises a hook 13*d* directed upward, intended for the support and the prepositioning of the metal reinforcement 14 on the wood framework 2.

The hook 13*d* forms a triangle obtained via stamping of one of the faces 13*b* of the metal part in a square constituting the connector 13. The hole 13*c* of the other face 13*a* is obtained in the same way as has an internal flange intended to enter the hole 19 of the post 12.

Figure 16:
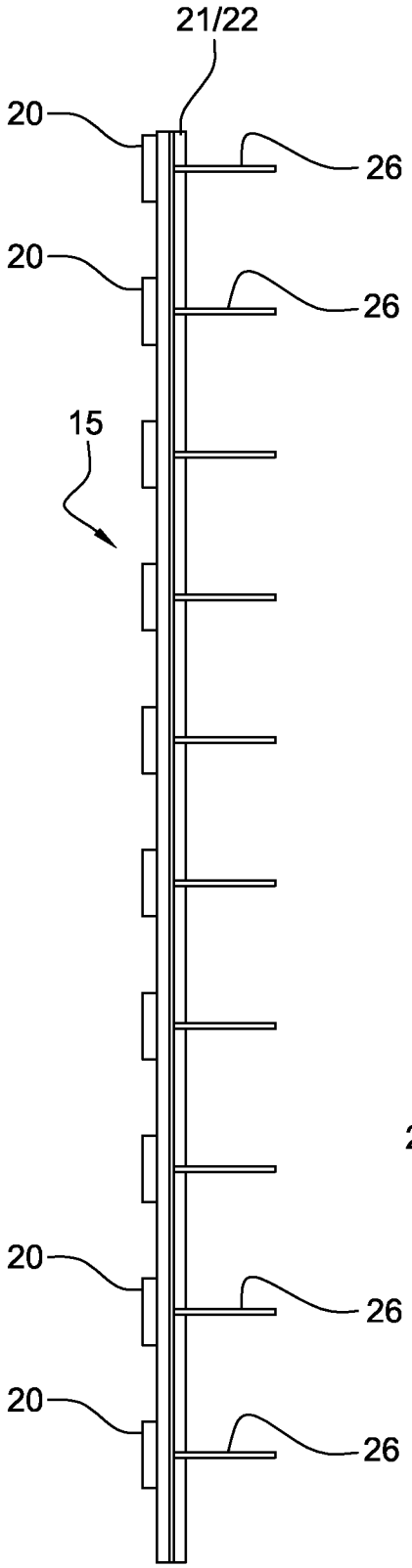
FIG. 16 shows a longitudinal view of a lateral assembly connector.
Figure 17:
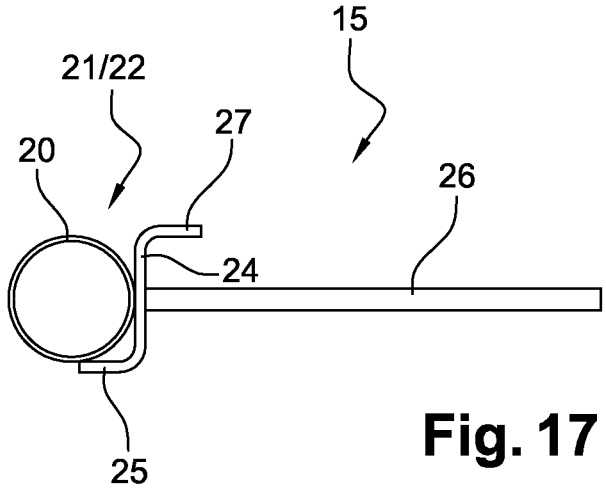
FIG. 17 shows a top view of the lateral connector according to FIG. 16.
Figure 18:
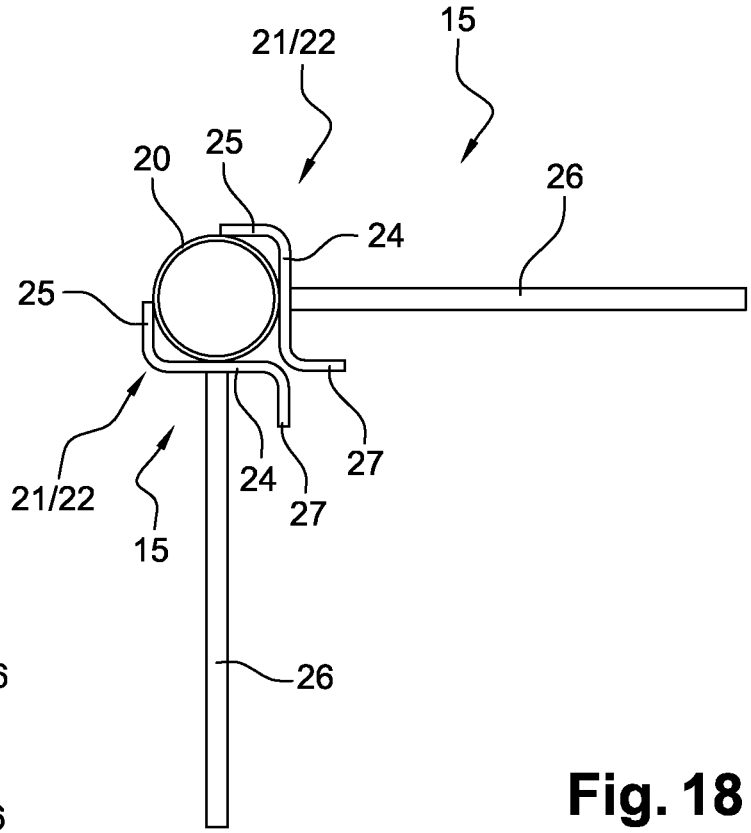
FIG. 18 shows, as a top view, two lateral connectors, perpendicular to one another, showing a link at 90° of the two panels to be produced.

According to another characteristic of the invention, which can be seen in FIGS. 16, 17 and 18, the vertical lateral assembly connectors 15 of two successive panels 1, 1A are comprised of cylindrical tube sections 20, added in a fixed manner on either side of the respective profiles 21, 22 of each panel 1, 1A in an alternative and shifted manner, in order to allow for their nesting in the manner of a hinge and of which their locking is carried out by the intermediary of a pin 23, engaged axially in order to provide a vertical keying between the panels 1, 1A.

Moreover, the tube sections 20 constituting the hinge portion of each panel 1 are made integral with a profile 21, 22, having at least two faces at 90° 24, 25 supporting the tubes 20 and comprising a plurality of linking stems 26 connected laterally to the metal reinforcement 14, with a view of being embedded in the concrete with the latter, during the pouring of the inner facing 4.

According to this example embodiment, the profile 21, 22 supporting the tube sections 20 and the linking stems 26 form three S-shaped branches 24, 25, 27 of which the two end branches 25, 27 are flat and perpendicular to each other and form an angle at 90° with the central branch 24, also flat, in such a way as to receive the sections of the tube 20 constituting a portion of the hinge, between the central branch 24 and the end branch 25 directed toward the exterior, the other end branch 27 directed in the opposite direction forming a stop with a corresponding branch 27 of the profile of another panel 1, when they are arranged according to an angle at 90°, outer.

Note that the two end branches 25, 27 of the profile 21, 22 contribute moreover in reinforcing the contact with the inner facing 4 during the pouring of the concrete constituting it, with the latter adding to the link by the stems 26, integral with said profile 21, 22.

Figure 19:
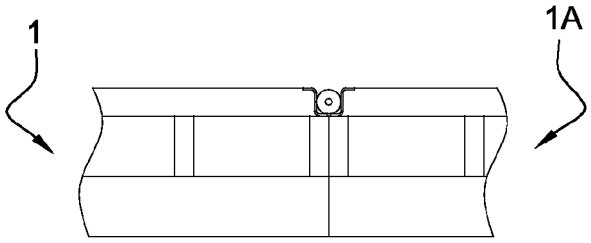
FIGS. 19 to 23 show, partially, as a top view, the link between two panels according to various possible angles.
Figure 20:
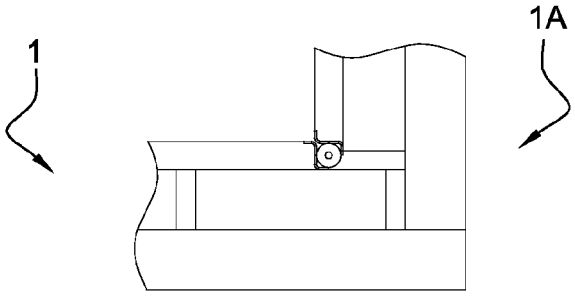
Figure 21:
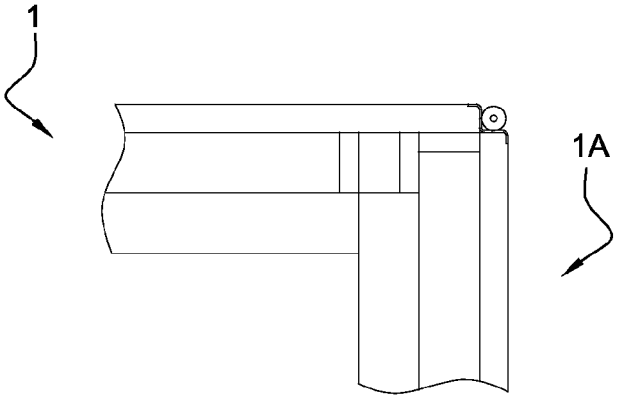
Figure 22:
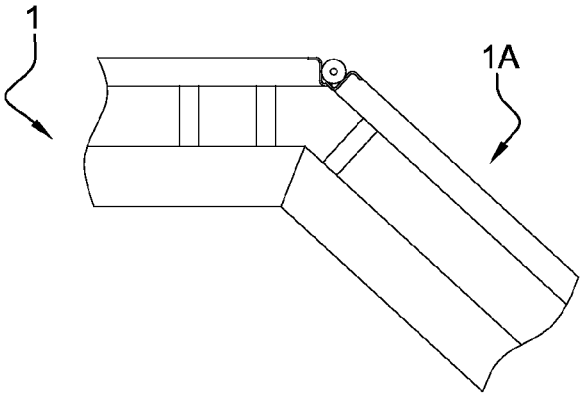
Figure 23:
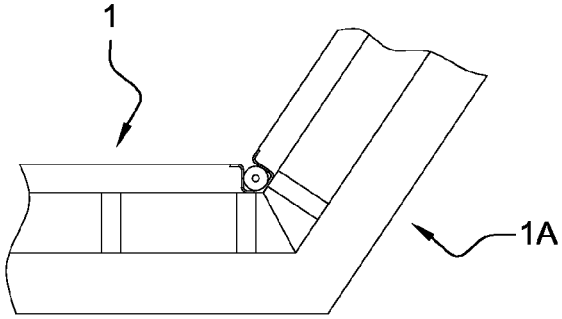
Figure 24:
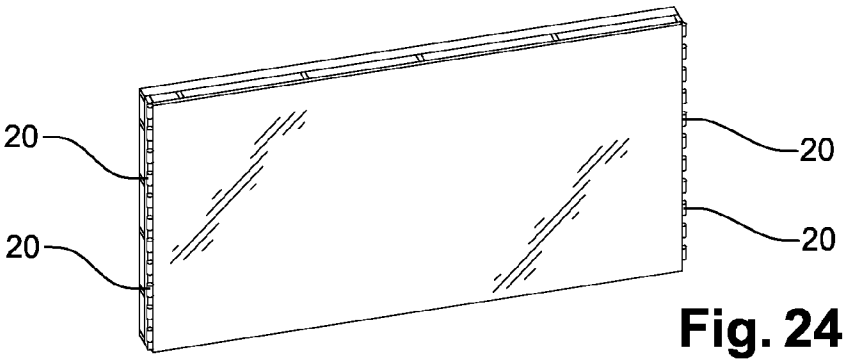
FIGS. 24, 25 and 26 show respectively, in perspective: a panel ready to install; two panels in the process of arrangement, in view of linking them; two panels after installation.
Figure 25:
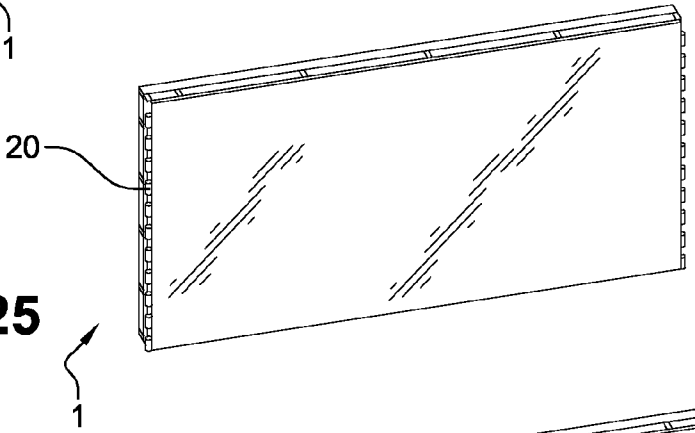
Figure 26:
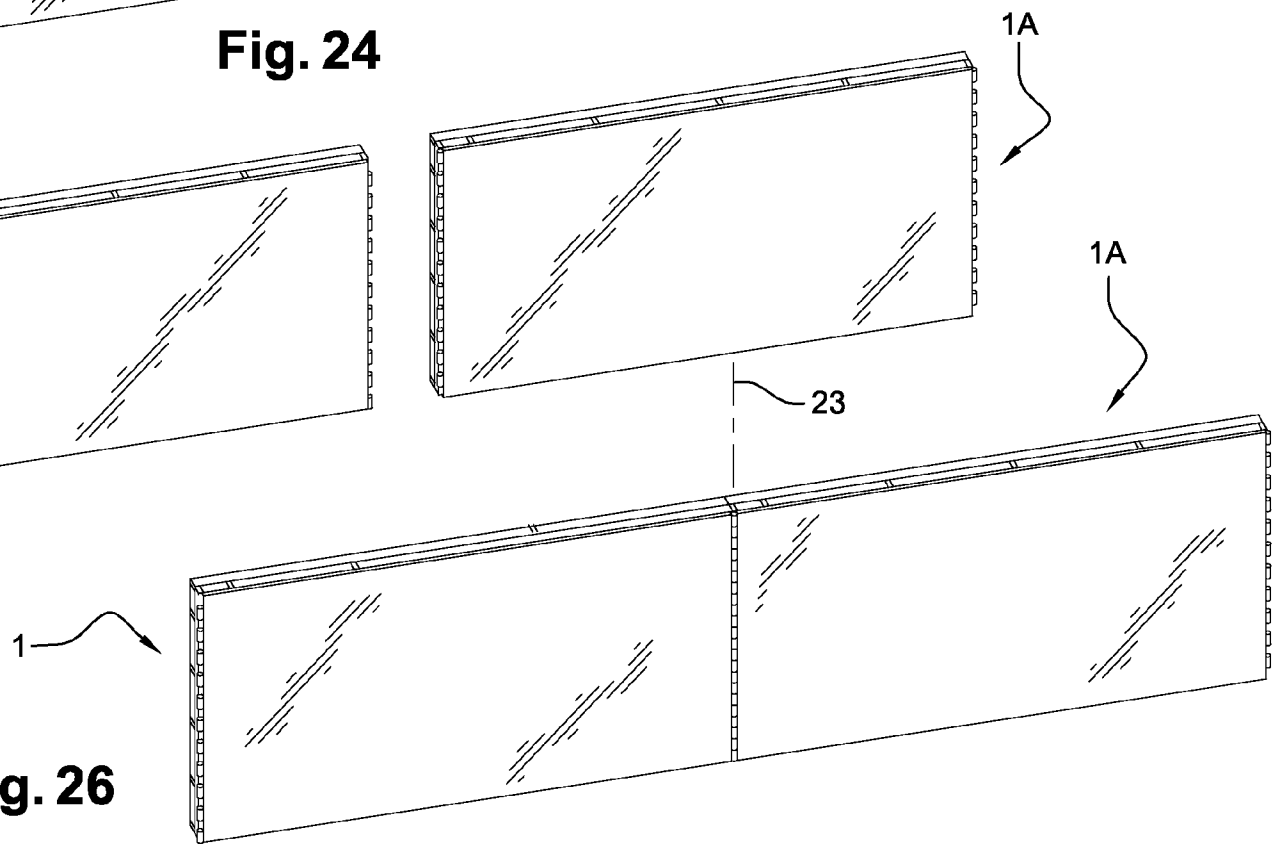

FIGS. 19 to 23 show the various linking possibilities between two panels 1 and 1A. It is as such that FIG. 19 shows a junction at 180°; FIG. 20 shows a junction at 90° (outer angle); FIG. 21 shows a junction at 270° (inner angle); FIG. 22 shows a junction at 225° (inner angle); FIG. 23 shows a junction at 135° (outer angle).

Figure 27:
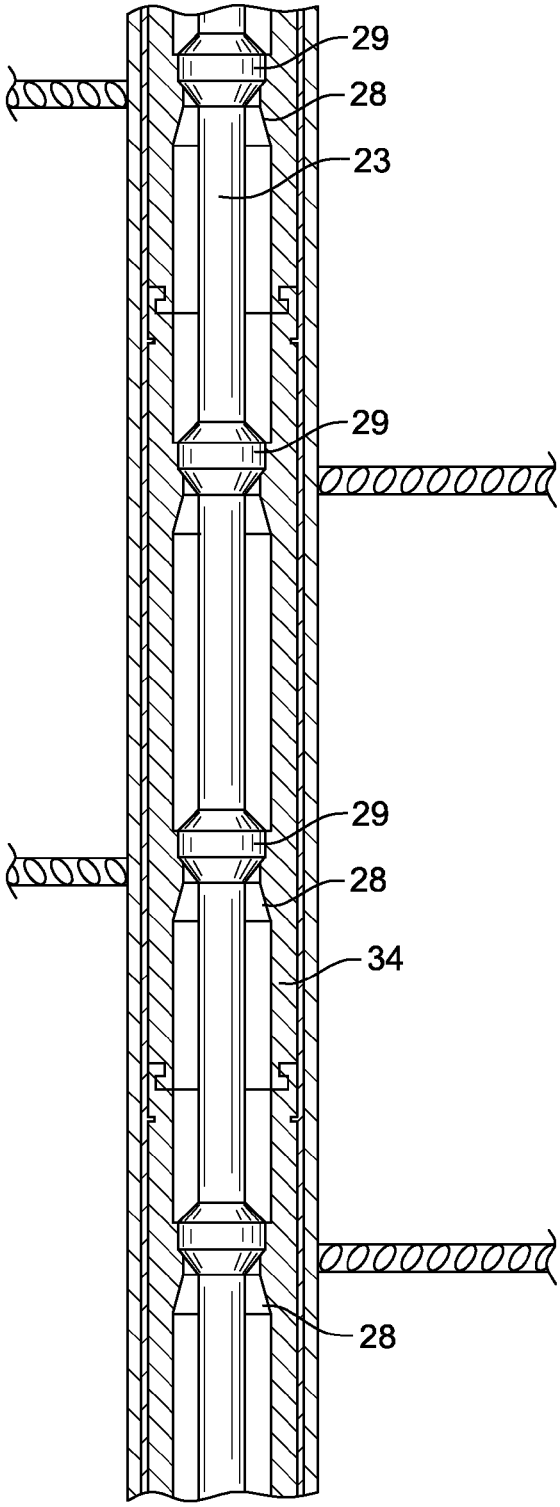
FIG. 27 is cross-section view of a vertical linking and locking element of two successive panels, when they are end to end.
Figure 28:
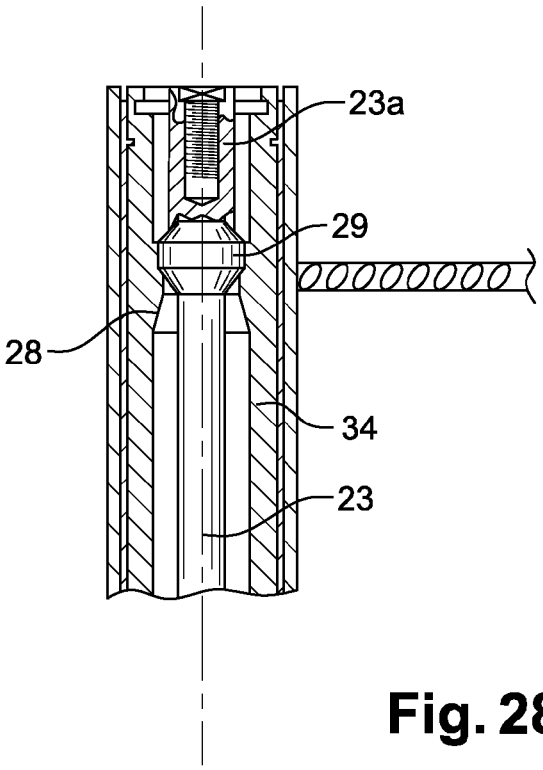
FIGS. 28 and 29 show the upper end of the linking and locking element according to FIG. 27, respectively locked and in the process of unlocking using an adapted tool.
Figure 29:
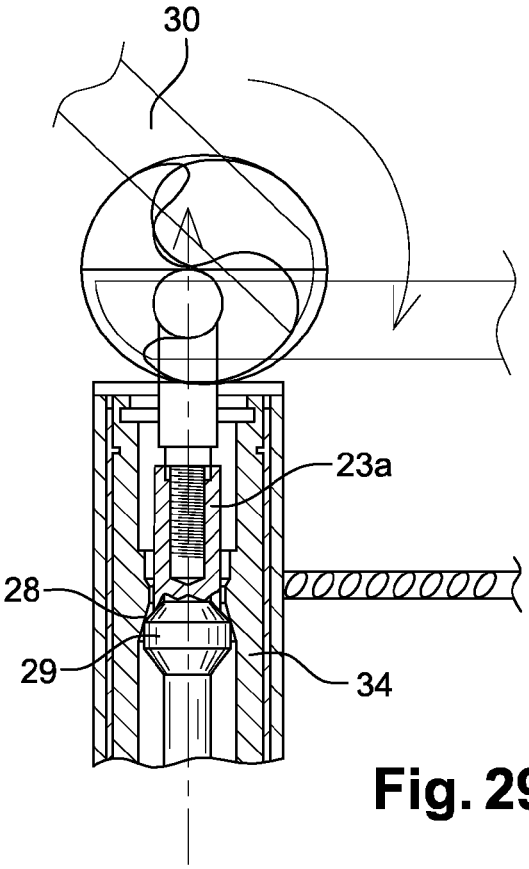

According to a particular embodiment shown in FIGS. 27, 28 and 29, the locking pin 23 is associated with an expandable sheath 34, wherein it is housed, in order to form a means of keying removable panels 1. Said sheath 34 is formed by two complementary half-shells, of which their length correspond substantially to that of the hinge and forming a cylinder with exterior dimensions substantially corresponding to those internal of the tube sections 20 comprising said hinge, to the nearest play. The internal wall of the sheath 34 has a plurality of peripheral bosses 28, spaced from each other, in order to punctually decrease the section, and cooperate in extension with the passage of other external bosses 29 of the pin 23, produced according to dimensions that are greater than those of the bosses 28 of the sheath 34, but according to an identical pitch, in order to offer reduced sections during the passage of the bosses 29 of the pin 23. As such, compression points are created, providing the locking, via axial translation, of the pin 23 in one direction and its unlocking in the other direction.

According to this same method of locking, FIGS. 28 and 29 show the implementation of an eccentric effect tool 30, acting on the end of the pin 23*a* in order to push it back, and therefore unlock the unit. Of course, the locking is carried out by acting in the opposite direction.

Another locking method can be carried out by the intermediary of an anti-shrinkage grout, but non-removable, by first introducing a blind and sealed sheath in the tube sections 20, then a metal axis guided by a plastic tip, with the vacuum between the axis and the sheath then being filled by an anti-shrinkage grout.

Figure 30:
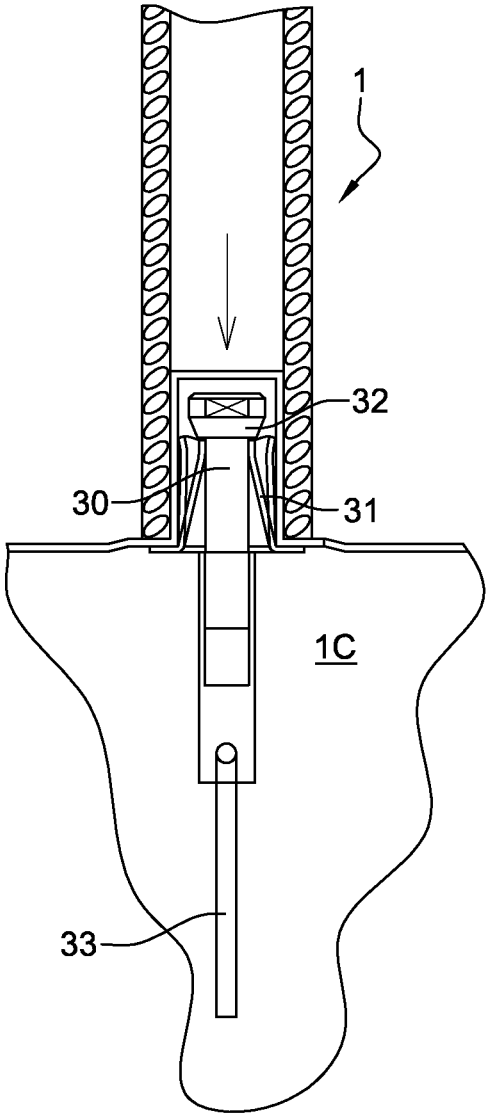
FIGS. 30 and 31 show respectively a horizontal linking and locking element of two successive panels, when they are superimposed.
Figure 31:
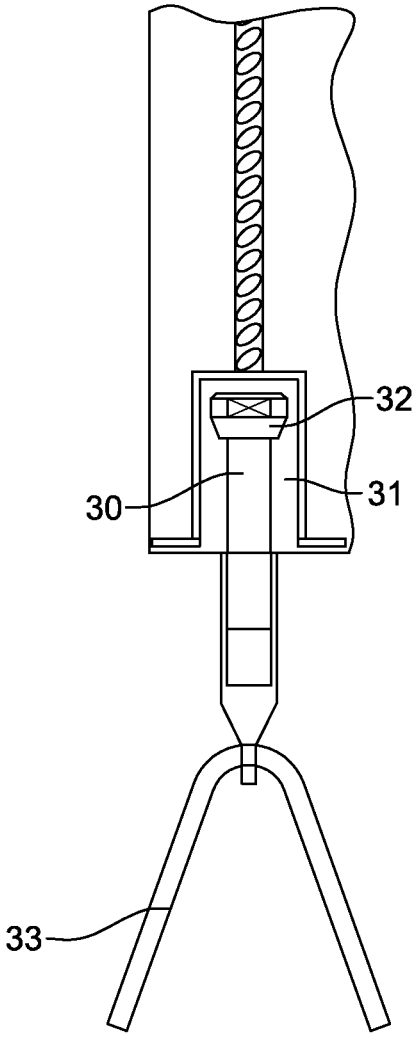

As can be seen in FIGS. 30 and 31, the means of assembly in the horizontal direction of two superimposed panels 1, 1C are constituted by a lug 30 fastened in the upper portion of a lower panel 1C and emerging from the latter in order to be nested, during the mounting, in an elastically deformable socket 31, inserted in the lower portion of an upper successive panel 1.

The lug 30 is embedded in the concrete of a lower panel 1C, during the molding operation, and has a flared end head 32, in such a way as to conquer the elasticity of the wall of the socket 31 of the upper panel 1 in the passage of the head 32 of lug 30 during the assembly, and in being housed under the latter in locking, at the end of travel.

The lug 30 is taken in the concrete of the panel 1C, by the intermediary of a bracket 33.

The invention claimed is:

1. Method for producing a structure using prefabricated panels, which is intended to be added on a free-standing supporting framework, said method comprising:

producing each of the pre-fabricated panels beforehand using a wood framework on which can be integrated an inner insulation and inner and outer facings, said prefabricated panels together by linking means in a vertical direction and in a horizontal direction;

producing a subassembly comprising forming the wood framework using a quadrangular wood frame using upper and lower lateral elements assembled together and corresponding to an external contour of the panel, installing wood vertical posts inside the wood frame according to a predetermined spacing, and installing said wood framework with inner facing mechanical connectors, on the vertical posts of the wood frame, arranging, supporting and prepositioning of a metal reinforcement on the connectors installed on the wood framework, connecting, on the two vertical sides of the reinforcement, of lateral assembly connectors together of two successive panels:

overmolding the subassembly comprising:

installing the subassembly produced as such in a mold of dimensions corresponding to dimensions of the panel to be obtained, by directing the metal reinforcement toward a bottom of the mold and by maintaining the metal reinforcement at a distance from this bottom, according to a value equal to a thickness of the inner facing desired, pouring a material through the wood framework, configured to integrate the metal reinforcement, intended to constitute the inner facing, and unmolding the panel after drying of the material, and finishing by installing a final outer facing or of a holding support.

2. Method according to claim 1, further comprising installing wood horizontal crosspieces on the vertical posts, according to a predetermined spacing.

3. Method according to claim 2, further comprising arranging insulating elements between the vertical posts, after pouring of the material constituting the inner facing and prior to the installation of the horizontal crosspieces.

4. Method according to claim 2, further comprising arranging insulating elements between the horizontal crosspieces, successively to the installation of the insulating elements.

5. Method according to claim 1, further comprising installing on the crosspieces a rain barrier, fastened and maintained by cleats, horizontal or vertical.

6. Method according to claim 5, further comprising, successively to the installation of the rain barrier, installing the outer facing or its holding support, by fastening on the cleats and/or the horizontal crosspieces.

7. Method according to claim 1, wherein the metal reinforcement to be integrated into the material of the inner facing during its pouring is a welded metal netting.

8. Method according to according to claim 1, wherein the material constituting the inner coating, to be poured into the mold, is a finished concrete.

* * * * *